United States Patent [19]

Boyer

[11] Patent Number: 4,497,365

[45] Date of Patent: Feb. 5, 1985

[54] HEAT EXCHANGER

[76] Inventor: John Boyer, 203 Eveningside Dr., Chattanooga, Tenn. 37404

[21] Appl. No.: 522,976

[22] Filed: Aug. 15, 1983

[51] Int. Cl.[3] ..... F28D 7/02; F28F 3/12

[52] U.S. Cl. ..... 165/164; 165/154; 165/169

[58] Field of Search ..... 165/154, 164, 169, 77

[56] References Cited

U.S. PATENT DOCUMENTS

| | | | |
|---|---|---|---|
| 2,625,804 | 1/1953 | Patch et al. | 165/77 X |
| 2,629,988 | 3/1953 | Lee | 165/77 X |
| 2,879,976 | 3/1959 | Rose, Sr. | 165/164 X |
| 4,203,186 | 5/1980 | Horner | 165/164 X |

*Primary Examiner*—Allen M. Ostrager
*Attorney, Agent, or Firm*—Alan Ruderman

[57] ABSTRACT

A heat exchanger having a hollow inner housing positioned within a hollow outer housing, each housing being incomplete about its periphery to provide a pair of spaced apart edges. Adjacent peripheral edges of the housings are connected together in sealed relationship along the entire length of the housings while maintaining the space between the peripheral edges of the same housing, and surfaces of the inner and outer housings opposite to the peripheral edges are secured together in sealed relationship so as to be readily bendable in hinging fashion to permit the spaced peripheral edges to be separated and positioned about an existing fluid carrying conduit. A pair of end closure caps are provided at each end connecting the inner and outer housings together and closing the ends to provide a pair of cavities between the two housings. Inlet and outlet tubes are provided to each cavity. The inner housing has a flange extending outwardly at each peripheral edge and fastening members are attached to the flanges to draw them together and tighten the inner housing against the conduit.

9 Claims, 5 Drawing Figures

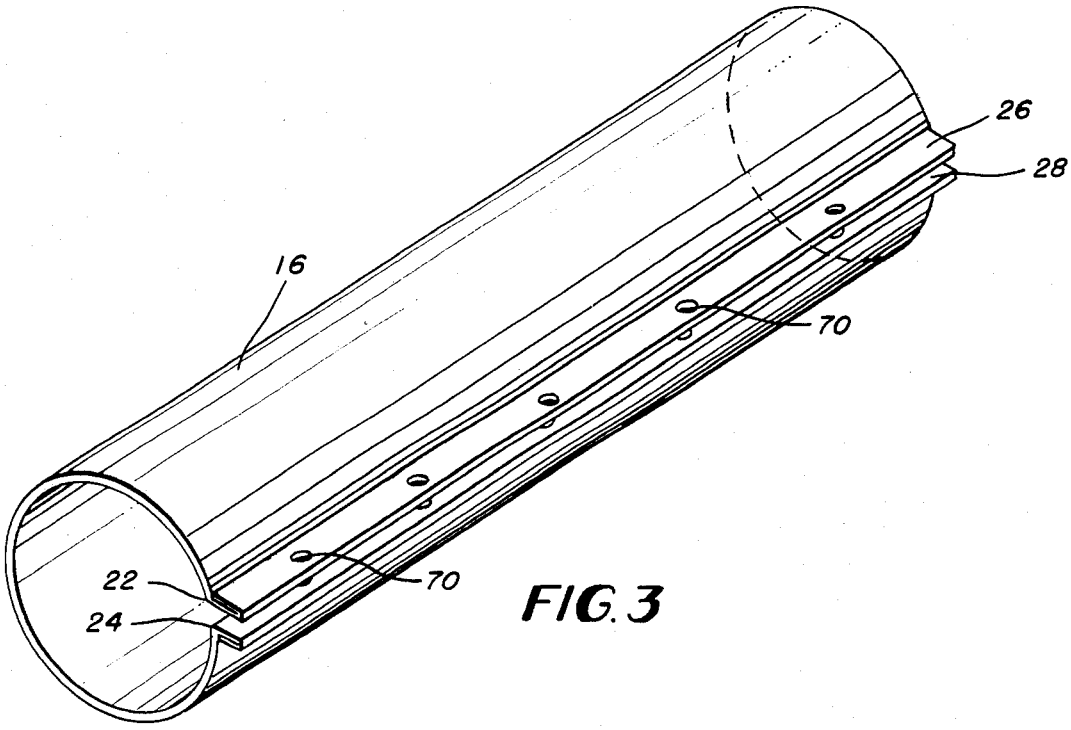
FIG. 3
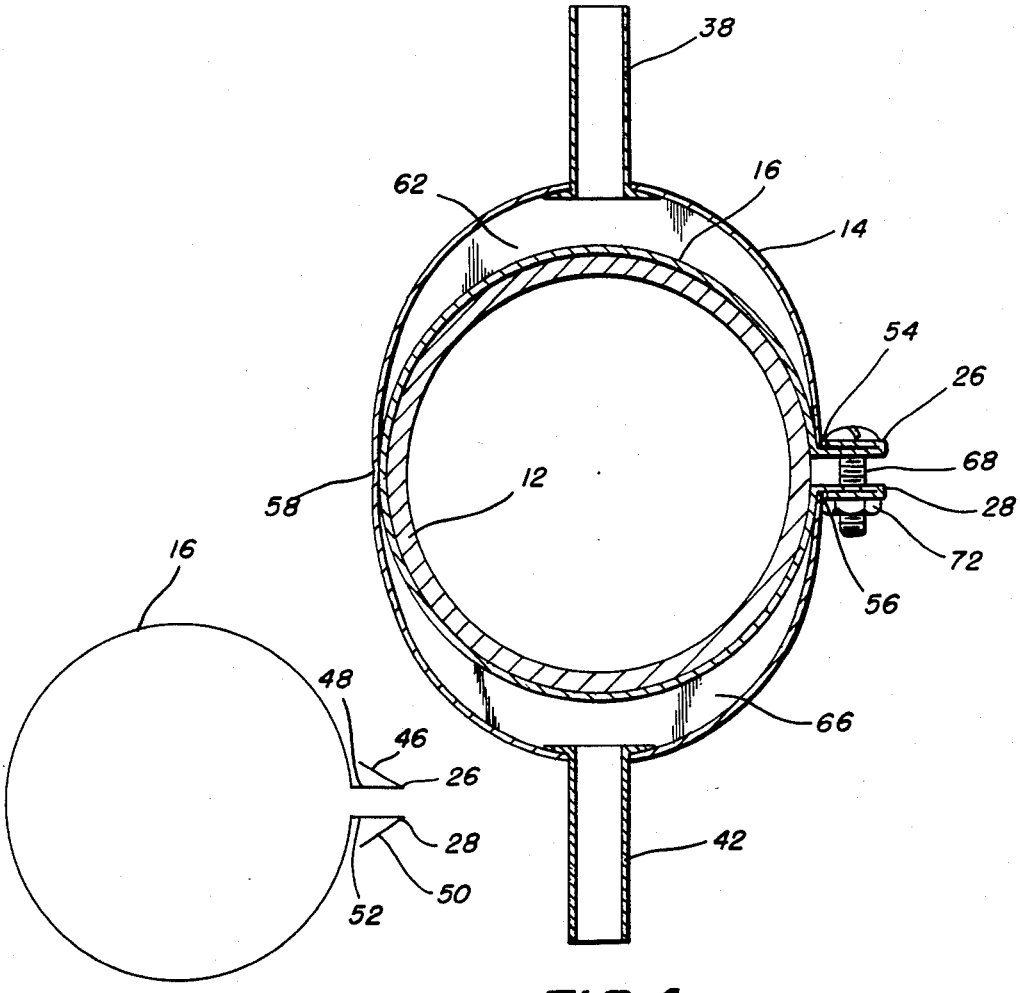
FIG. 5
FIG. 4

HEAT EXCHANGER

BACKGROUND OF THE INVENTION

This invention relates to heat exchangers and more particularly to a heat exchanger having an inner and outer housing that may be positioned about an existing fluid carrying pipe, without cutting the pipe, to transfer heat from the pipe to a fluid directed into and out of the space between the housings.

There exists in many buildings and industrial installations a number of heated fluid carrying pipes in which the heat is dissapated to the ambient environment of the room in which the pipe is confined. Consequently, there is a large amount of heat energy that is presently wasted which could be utilized for heating or pre-heating purposes if a convenient means were available for capturing this energy.

Conventional heat exchangers must be installed in flow communication with the fluid carrying pipe in order to transfer the heat to a secondary fluid. This requires shutting the flow of the primary fluid to the pipe so that the heat exchanger can be inserted. Thus, the system using the primary fluid must be shut down and thereafter started up, and many circumstances exist in which this inconvenience prevents the installation of a heat exchanger. This is particularly true where the primary fluid is under a high pressure and high temperature state. Thus, it is highly desirable to provide a heat exchanger which can be installed without requiring the flow of the primary fluid to be shut.

It is known in the prior art to provide heat exchangers that can be attached by bolting about a heated fluid carrying pipe, but these known devices are of the radiating fin type which merely provide a heat sink to transfer the heat to the ambient environment. A search of the prior art developed the following United States Patents, but none discloses apparatus directed to the solution of this problem: U.S. Pat. Nos. 3,206,836; 2,801,828; 2,625,804; 1,938,441 and 1,811,816.

SUMMARY OF THE INVENTION

Consequently, it is a primary object of the present invention to provide a heat exchanger that may be positioned about an existing fluid carrying pipe for transferring heat energy between the pipe and a fluid directed into and out of the heat exchanger.

It is another object of the present invention to provide a heat exchanger that may be connected in heat transferring communication with a conduit without necessitating severing of the conduit to insert the heat exchanger.

It is a further object of the present invention to provide a heat exchanger positionable about an existing primary fluid carrying pipe, the heat exchanger having an inner and an outer housing between which a secondary fluid may flow, the inner housing being disposed in substantially abutting relationship with the pipe.

It is a still further object of the present invention to provide a heat exchanger having an inner and outer housing hingedly bendable about longitudinally extending surfaces and connected together about common longitudinally extending spaced apart edges of each housing so that the housings may be positioned about an existing pipe and secured with the inner housing substantially abutting the exterior of the pipe, the heat exchanger having end closures so the space between the housings may communicate with fluid inlet and outlet means for confining a flowing fluid within the space for transfer of heat between that fluid and a fluid flowing within the pipe.

Accordingly, the present invention provides a heat exchanger comprising an outer housing and an inner housing of finite length and positioned one within the other, each housing being incomplete about the respective periphery to provide a pair of spaced apart peripheral edges, corresponding peripheral edges of the inner and outer housing being secured together in sealed relationship along the entire lengths thereof to form a longitudinally extending space between the housings, closure members closing the space at each end and connecting the inner and outer housings together in sectors extending from respective spaced apart peripheral edges to locations disposed substantially opposite thereto while permitting bending of said housings along the length of said housings between said locations to open the space between the peripheral edges so that the housings can be positioned about a fluid containing conduit, inlet and outlet means communicating with the space for permitting a fluid to flow therethrough, and means for drawing and fastening the spaced peripheral edges together to dispose the inner jacket in substantial abutting relationship with the conduit so that heat energy may flow between the inner housing and the conduit.

In the preferred form of the invention the inner and outer housings are connected together about corresponding surfaces opposite the peripheral edges so as to be readily bendable by hinging about the connecting surfaces. There may be a pair of closure members at each end, each closure member extending from a respective spaced peripheral edge of the housings to a terminal edge along the connecting surfaces, the housings thereby being readily hingable at or intermediate the terminal edges. For drawing the spaced sealed peripheral edges together there is provided a pair of opposed longitudinally extending flanges, each flange being secured to a respective one of the secured together peripheral edges so that fasteners may extend through and draw the flanges and thus the housings together along said edges.

BRIEF DESCRIPTION OF THE DRAWINGS

The particular features and advantages of the invention as well as other objects will become apparent from the following description taken in connection with the accompanying drawings, in which:

FIG. 3 is a perspective view of the inner housing of the heat exchanger removed from the outer housing;

FIG. 4 is a transverse cross sectional view taken substantially through the section and in the direction illustrated at line 4—4 of FIG. 1; and FIG. 5 is a schematic cross sectional view of the inner housing prior to attaching to the outer housing.

DESCRIPTION OF THE PREFERRED EMBODIMENTS

Figure 1:
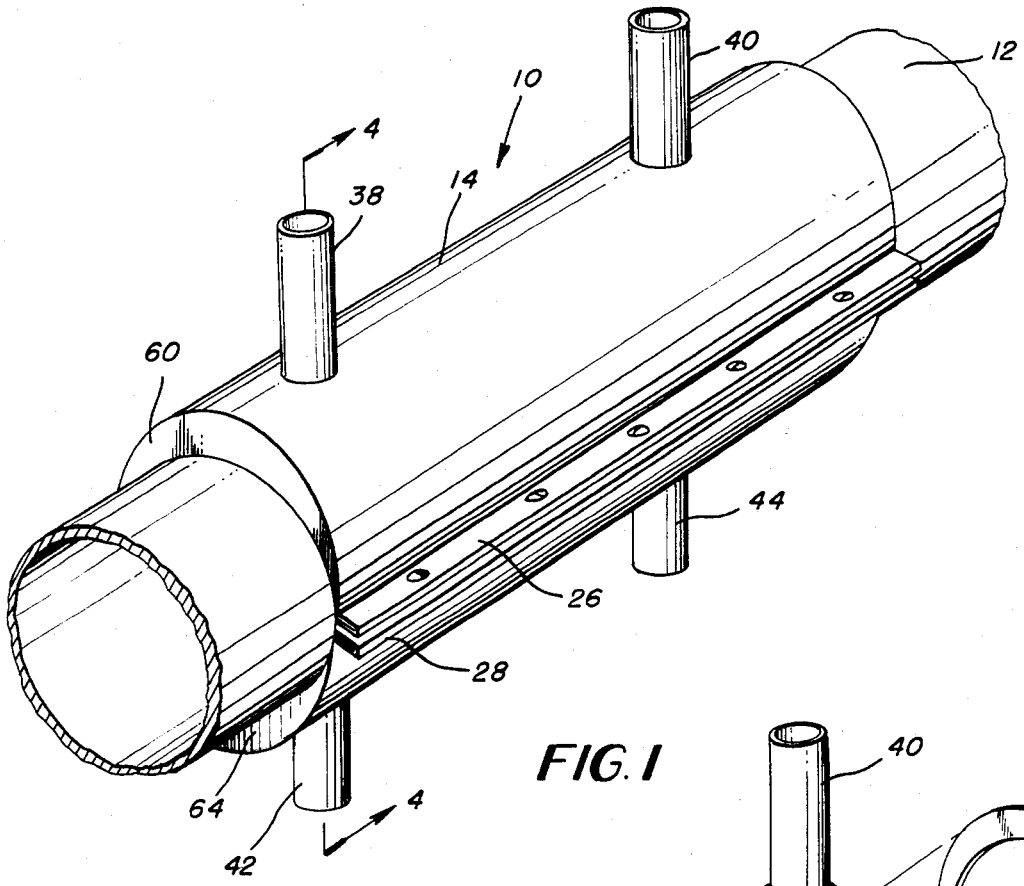
FIG. 1 is a perspective view of a heat exchanger constructed in accordance with the principles of the present invention mounted about a pipe illustrating the manner of use.

Referring to the drawings a heat exchanger constructed in accordance with the present invention is illustrated generally at 10 in a disposition about a pipe or other fluid carrying conduit 12. The heat exchanger 10 comprises an outer thin walled housing 14 disposed about an inner thin walled housing 16, at least the inner housing, and preferably both, being of a cross sectional configuration conforming substantially to the shape of the conduit 12 with which it is to function, and which is illustrated in FIGS. 1 and 4 as being circular. Thus, each housing 14, 16 in the illustrated embodiment is a substantially cylindrical hollow body member but the periphery of each is incomplete so that a space is formed between peripheral edges 18, 20 of the outer housing 14, and peripheral edges 22, 24 of the inner housing 16. At least the inner housing comprises a material having a high co-efficient of heat transfer such as brass or copper, but preferably both housings are formed from material that may be soldered, brazed or compression welded. In the preferred embodiment a flange 26, 28 extends outwardly from each peripheral edge 22, 24 of the inner housing the entire length thereof. Although the housing bodies should be elongated the same length, the length of the housings, 14, 16 may be selectively predetermined depending upon the desired capacity of the heat exchanger.

Figure 2:
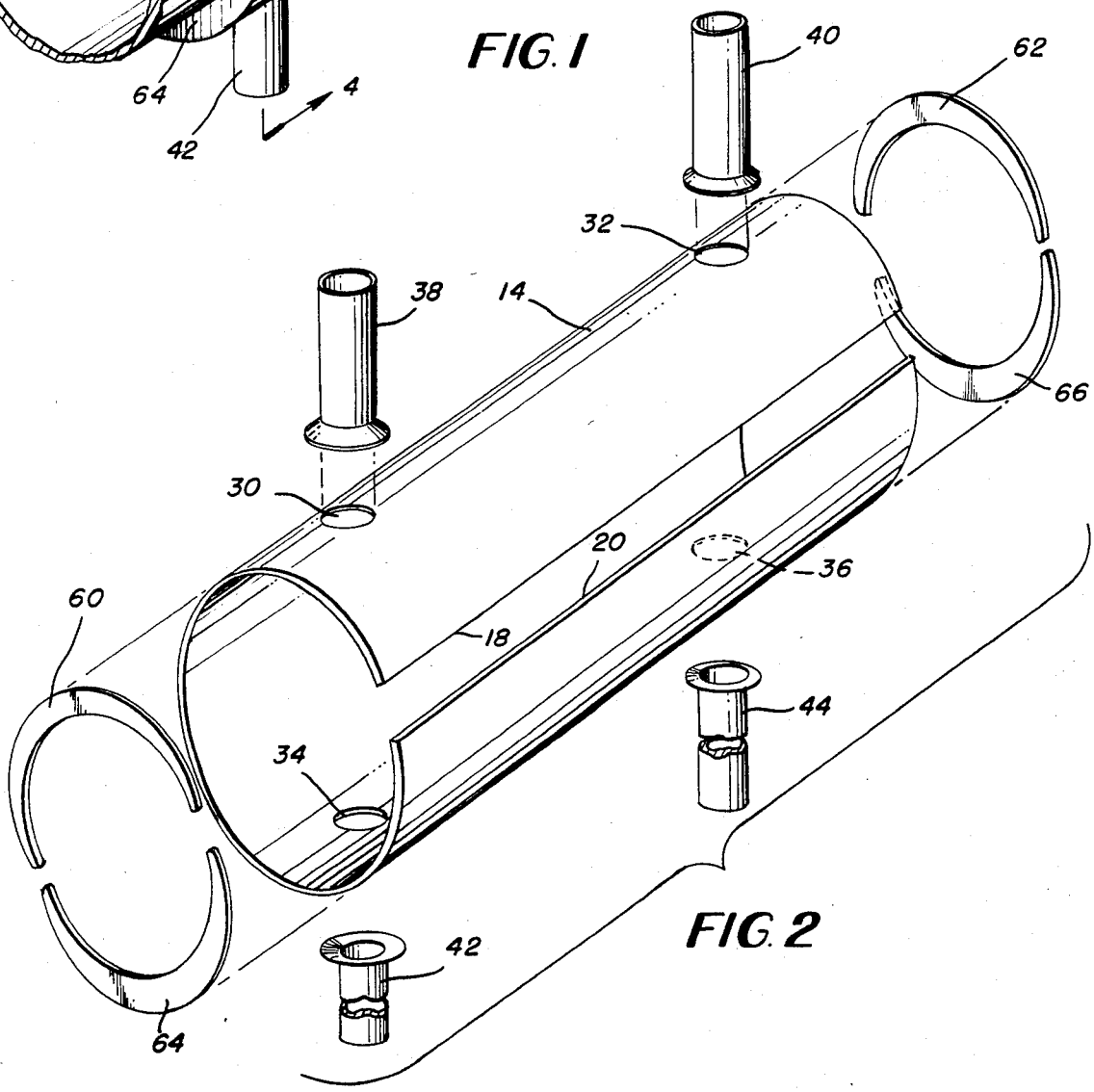
FIG. 2 is a disassembled perspective view of the elements comprising the heat exchanger of FIG. 1 except for the inner housing.

The outer housing as illustrated in FIG. 2 includes a number of apertures 30, 32, 34, 36 for receiving a respective tube or nipple 38, 40, 42, 44 each of which preferably has a flare at one end thereof. The nipples may be inserted through the respective apertures from the inside of the outer housing so that the flared portion may abut the inner surface thereof about the aperture with the nipples extending.outwardly from the housing 14. The nipples may then be secured to the outer housing by soldering or the like to provide inlets and outlets for secondary fluid entering and leaving the heat exchanger. As hereinafter described one of the nipples 38, 40 may be an inlet and the other an outlet for the upper portion of the heat exchanger, while one of the nipples 42, 44 may be an inlet and the other an outlet for the lower portion of the heat exchanger.

The inner housing 16 is inserted into the outer housing 14 with the flanges 26, 28 extending through the space between the peripheral edges 18, 20, as best illustrated in FIG. 4. The edges 18 and 20 may thereafter be fastened to the flanges 26, 28 in sealing relationship. To this end each of the flanges 26, 28 may be formed from a double thickness of the material comprising the inner housing folded back upon itself. As illustrated in FIG. 5 the flange 26 may be formed by folding a first flap 46 back onto a second flap 48, the flaps being of equal widths and being equal to that of the assembled flange. Similarly the flange 28 may be formed by flaps 50 and 52. When the flanges are so constructed corresponding flaps may be compression welded together and to the respective edges 18, 20 of the outer housing as indicated at 54 and 56 respectively. At a substantially diametrically opposed location relative to the connections 54, 56 between the peripheral ends of the housings 14, 16, the surface of the housings may be compression welded together at least along a longitudinally extending line as indicated at 58 in FIG. 4. Of course, soldering etc. may be utilized to fasten the housings together at 54, 56 and 58 instead of compression welds. In this manner two separate cavities are formed between the housing, one cavity communicating with the nipples 38 and 40, and the other cavity communicating with the nipples 42 and 44.

At the end of the housings the respective cavities are closed by end closure caps fastened between the housings in sealing relationship. Thus, closure caps 60 and 62 seal one cavity and closure caps 64 and 66 seal the other cavity. The end closure caps are substantially crescent shaped members of a configuration to fit the area between the housings extending from the points 54, 56 respectively to or adjacent the point 58, preferably adjacent the point 58 so that the caps at each end do not contact each other which could inhibit bending. The end closure caps may then be soldered to the longitudinal ends of the inner and outer housings.

In use, the heat exchanger may be bent or folded about the point 58 as a hinge to open the space between the flanges 26 and 28 so that the inner housing may be disposed about the conduit 12. The housings are thereafter bent back in the opposite direction to close the space between the flanges 26, 28 and screws 68 may be inserted through holes 70 formed in the flanges and secured by nuts 72 which are tightened until the heat exchanger is securely positioned about the conduit 12. By constructing the inner jacket such that its inner surface is substantially the same shape and size as the outer surface of the conduit, i.e., the same diameter in the case of a cylindrical conduit, when the flanges 26, 28 are drawn together surface contact between the inner housing and the conduit will occur. Thus, when a fluid is flowing through the heat exchanger an efficient transfer of heat will occur between that fluid and the fluid flowing within the conduit 12.

In a modified form of the invention the connection between the inner and outer housings may be omitted at the location 58 diametrically opposite the flanges. In that case only one cavity will be provided between the inner and outer housings 16, 14 respectively, and only one pair of nipples, e.g., 38 and 44 would be required. Moreover, in such case only a single end closure cap may be required at each end, each cap however, being narrow enough to be bendable at the location about which the housings are bent for receiving the conduit.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A heat exchanger adapted to be disposed about an existing fluid carrying conduit to transfer heat between the fluid in said conduit and the fluid flowing through said heat exchanger, said heat exchanger comprising hollow thin walled outer and inner hollow housings of finite length positioned one within the other, said inner housing having a cross sectional configuration and size substantially conforming to the exterior of said conduit, each housing being incomplete about the respective periphery to provide a respective pair of spaced apart peripheral edges, means for securing each peripheral edge of the outer housing to a corresponding peripheral edge of the inner housing in sealed relationship along the length of each housing, means for securing the outer housing to the inner housing at adjacent facing surfaces in substantially sealed relationship along the length of said housings at a location substantially opposite said peripheral edges to form a pair of longitudinally extending cavities between said housings, fluid inlet and outlet means communcating with each cavity, end closure means secured to the ends of both housings for closing each cavity at each end of the housings while permitting said housings to hingedly bend along said secured surfaces when a force is applied to separate and open the space between the peripheral edges of the inner housing and the peripheral edges of the outer housing to permit entrance of said conduit through said space for disposition of said housings about said conduit, and fastening means for drawing and fastening the spaced peripheral edges together so that at least a substantial portion of the inner housing abuts the conduit.

2. A heat exchanger as recited in claim 1 including a flange extending along and outwardly from each peripheral edge of the inner housing, and said fastening means connects said flanges together.

3. A heat exchanger as recited in claim 1, wherein said end closure means comprises a pair of closure members at each end of said housings, one member of each pair closing one cavity and the other member of each pair closing the second cavity.

4. A heat exchanger as recited in claim 3, wherein the closure members at each end are spaced from each other to permit the housings to readily hinge intermediate the closure members.

5. A heat exchanger as recited in claim 4, wherein said closure members are crescent shaped.

6. A heat exchanger as recited in claim 5 including a flange extending along and outwardly from each peripheral edge of the inner housing, and said fastening means connects said flanges together.

7. A heat exchanger as recited in claim 1, wherein said inlet and outlet means for each cavity comprises a tube secured to the outer housing adjacent opposite ends thereof, a tube at one end being a fluid inlet and a tube at the other end being a fluid outlet.

8. A heat exchanger adapted to be disposed about an existing fluid carrying conduit to transfer heat between the fluid in said conduit and a fluid flowing through said heat exchanger, said heat exchanger comprising hollow thin walled outer and inner housings of finite length positioned one within the other, said inner housing having a cross sectional configuration and size substantially conforming to the exterior of said conduit, each housing being incomplete about the respective periphery to provide a respective pair of spaced apart peripheral edges, means for securing each peripheral edge of the outer housing to a corresponding peripheral edge of the inner housing in sealed relationship along the length of each housing to form a longitudinally extending cavity between said housings, fluid inlet and outlet means communicating with said cavity, end closure means secured to the ends of both housings for closing the cavity at each end of the housings, said closure means being of a shape and disposition to permit said housings to hingedly bend along surfaces substantially opposite said peripheral edges by application of a force applied to separate and open the space between the peripheral edges of the inner housing and the peripheral edges of the outer housing to permit entrance of said conduit through said space for disposition of said housings about said conduit, and fastening means for drawing and fastening the spaced peripheral edges together so that at least a substantial portion of the inner housing abuts the conduit.

9. A heat exchanger as recited in claim 8, including a flange extending along and outwardly from each peripheral edge of the inner housing, and said fastening means connects said flanges together.

* * * * *